US007267619B1

(12) United States Patent
Pettis

(10) Patent No.: US 7,267,619 B1
(45) Date of Patent: Sep. 11, 2007

(54) GOLF CLUB BALANCING APPARATUS

(76) Inventor: William J. Pettis, 125 College St., N., Poultney, VT (US) 05764

( * ) Notice: Subject to any disclaimer, the term of this patent is extended or adjusted under 35 U.S.C. 154(b) by 0 days.

(21) Appl. No.: 11/471,450

(22) Filed: Jun. 21, 2006

(51) Int. Cl.
*A63B 53/10* (2006.01)
*A63B 53/12* (2006.01)

(52) U.S. Cl. ..... 473/297

(58) Field of Classification Search ..... 473/297–299, 473/292, 318, 519–521, 523
See application file for complete search history.

(56) References Cited

U.S. PATENT DOCUMENTS

| | | | | |
|---|---|---|---|---|
| 2,051,083 | A | 8/1936 | Hart | |
| 3,877,698 | A * | 4/1975 | Volpe | 473/520 |
| 4,461,479 | A * | 7/1984 | Mitchell | 473/292 |
| 4,600,195 | A * | 7/1986 | Hunter | 473/297 |
| 5,316,300 | A | 5/1994 | Simmons | |
| 5,364,102 | A | 11/1994 | Appledorn | |
| 5,465,967 | A | 11/1995 | Boeckenhaupt | |
| 5,575,722 | A | 11/1996 | Saia et al. | |
| 5,632,691 | A | 5/1997 | Hannon et al. | |
| 5,716,289 | A | 2/1998 | Okoneski | |
| 5,718,643 | A * | 2/1998 | Wright et al. | 473/297 |
| 5,902,656 | A * | 5/1999 | Hwang | 428/36.91 |
| 6,007,431 | A * | 12/1999 | Bloom, Jr. | 473/292 |
| 6,186,904 | B1 | 2/2001 | Bass | |
| 6,231,456 | B1 * | 5/2001 | Rennie et al. | 473/316 |
| 6,361,451 | B1 | 3/2002 | Masters et al. | |
| 6,620,053 | B2 | 9/2003 | Tseng | |
| 6,743,116 | B2 | 6/2004 | Wilbur | |
| 2001/0005696 | A1 * | 6/2001 | Hedrick | 473/318 |
| 2003/0022729 | A1 * | 1/2003 | Pergande et al. | 473/332 |
| 2004/0224787 | A1 * | 11/2004 | Lindner | 473/316 |
| 2005/0009620 | A1 * | 1/2005 | Hodgetts | 473/300 |
| 2005/0054459 | A1 * | 3/2005 | Oldenburg | 473/297 |

* cited by examiner

*Primary Examiner*—Stephen Blau
(74) *Attorney, Agent, or Firm*—John J. Welch, Jr., Esq.

(57) ABSTRACT

A golf club balancing apparatus consisting of an elongated, pliable housing component tapered as respects the top portion thereof with flexible, durable ribbing affixed to the exterior walling of the remnant portion of the housing component serving to hold the housing component snugly with the butt end of a golf shaft and within the housing component being interiorly hollowed out so as to receive one or more weight units of various lengths and masses amenable to insertion therein or removal therefrom via the open hole in the top side of a golf club grip by way of resort to utilization of an insertion tool.

8 Claims, 9 Drawing Sheets

GOLF CLUB BALANCING APPARATUS

CROSS REFERENCES TO PRIOR OR PARENT APPLICATIONS

Figure 1:
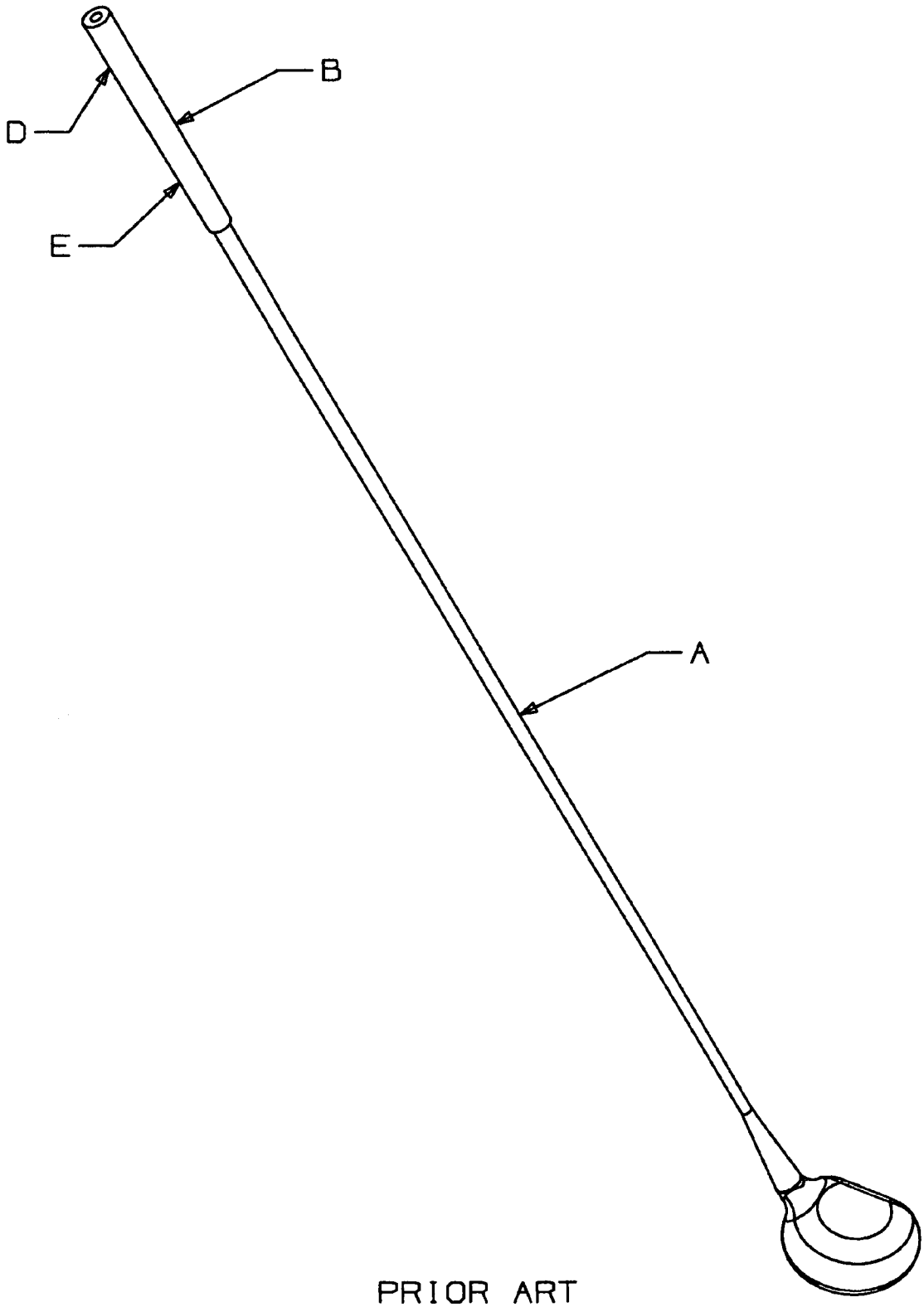
PRIOR ART FIG. 1

There are no prior or parent applications involving the instant invention.

FEDERALLY SPONSORED RESEARCH AND DEVELOPMENT

There is no federally sponsored research and development involving the instant invention.

BACKGROUND OF THE INVENTION

1. Field of the Invention

The invention is one of those devices serving to facilitate amelioration of the effect realized from the impact to a golf ball from a golf club being swung at it.

2. Art Information Statement

The Art Information Statement submitted herewith references art that however does not anticipate the instant invention.

A SUMMARY OF THE INVENTION

1. A Brief Description of the Invention

The instant invention consists of an elongated pliable housing component. The housing component is tapered in shape near the top portion thereof. It is hollow inside. It has flexible, durable ribbing about its outer walling to facilitate its snugly fitting into the butt end portion of a golf club. At the mid-portion of the housing component, the inner walling thereof is characterized by the presence of flexible ribbing circularly affixed thereto. A series of small weight units of varying length and mass are equipped with male and/or female threading at each end thereof. An insertion tool with a male threaded end is used to insert one or more of the weight units threaded together into the hollow portion of the housing component via the hole in the topside of a golf club grip once the housing component would previously have been inserted into the butt end of the shaft of the club and the grip then replaced thereupon. The insertion tool also serves to permit removal of a weight or weights therefrom as well.

2. Objects of the Invention

It is often said that an uncontrollable slice is the ultimate bane of any golfer's swing. The invention serves to obviate the slice from the swing. The mechanics of a golf swing invariably have to do with downswing path into impact. The lie of this path is a function of the golfer's ability to somewhat control ultimately the downward movement of the golf club being utilized to strike a golf ball. Such control ultimately depends upon the balance that exists as between the maximum pressure points on each of the golfer's hands as they are found on the moving club, the pressure accordingly exerted thereupon by the hands and the weight of the club itself to be felt by the golfer where the downward moving club is being held by the golfer near the butt end thereof. Moreover, the speed of a golf swing varies from golfer to golfer. The accuracy and length of golf ball flight depends upon swing path and swing speed. The invention by providing an enhancement of appropriate hand-pressure— club weight balance serves to greatly facilitate a golfer's ability to maintain an optimally directed downswing club path while at the same time increasing swing and ultimately clubhead speed all in the interest of increasing both distance and accuracy in respect of post-impact golfball flight. The inherent simplicity of the invention and its relative ease of use in the face of its unquestionable efficacy renders it as being, respectfully submitted, not only new, useful and unique, but indeed as being truly revolutionary in the art of devices meant to maximize proper control of a golf club during the downward portion of a golf swing.

A DESCRIPTION OF THE DRAWINGS

Figure 2:
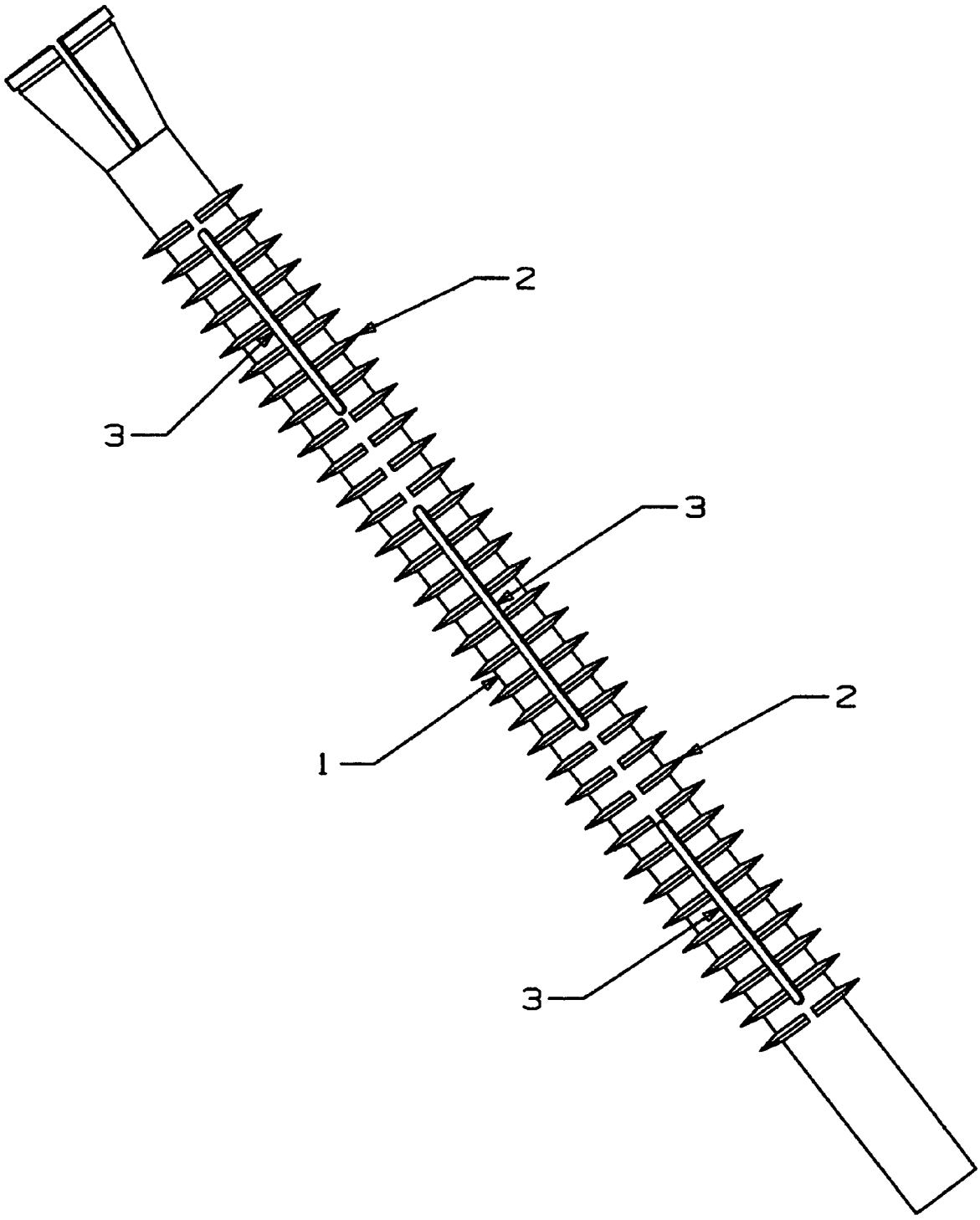
Figure 3:
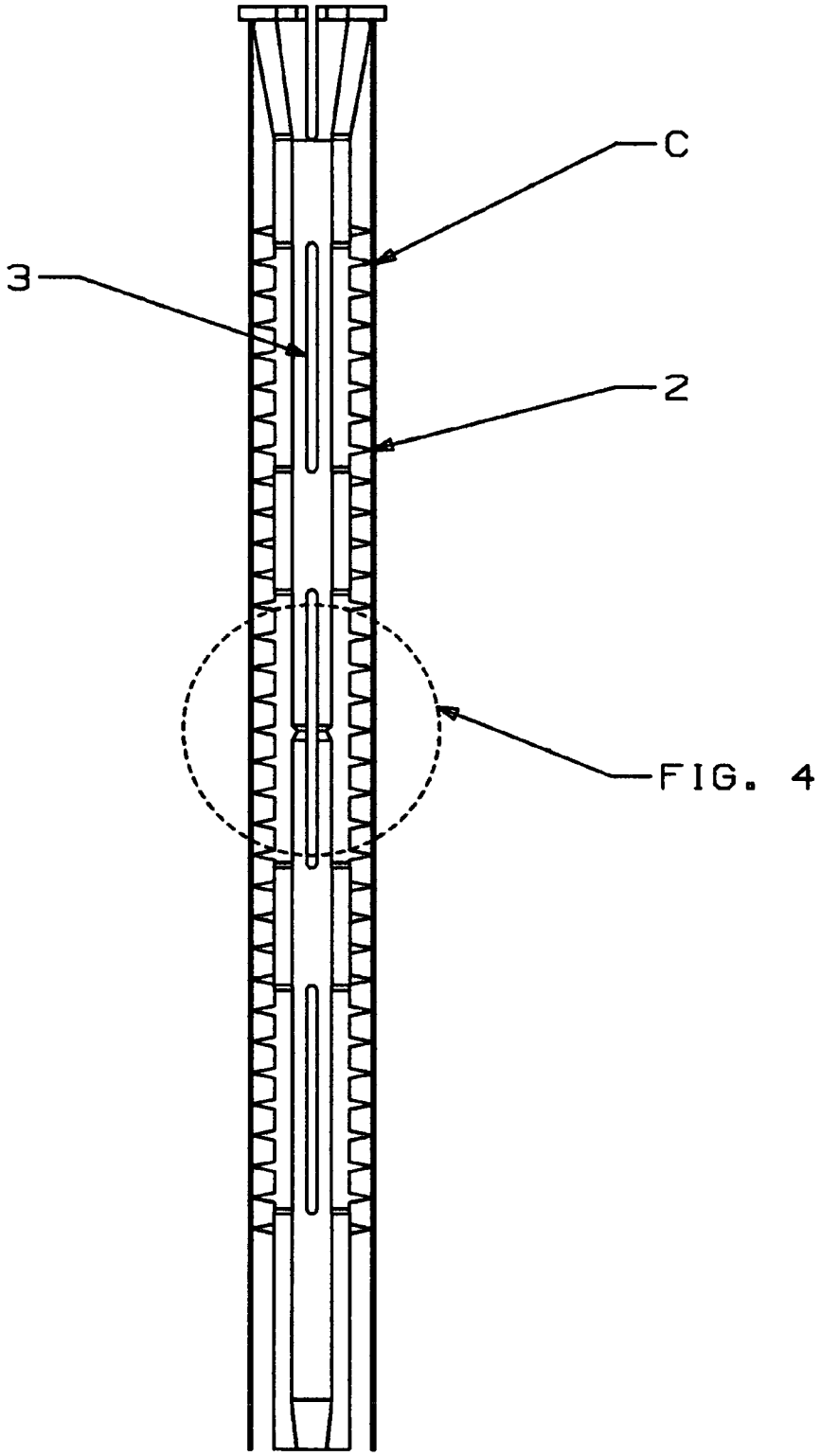
Figure 4:
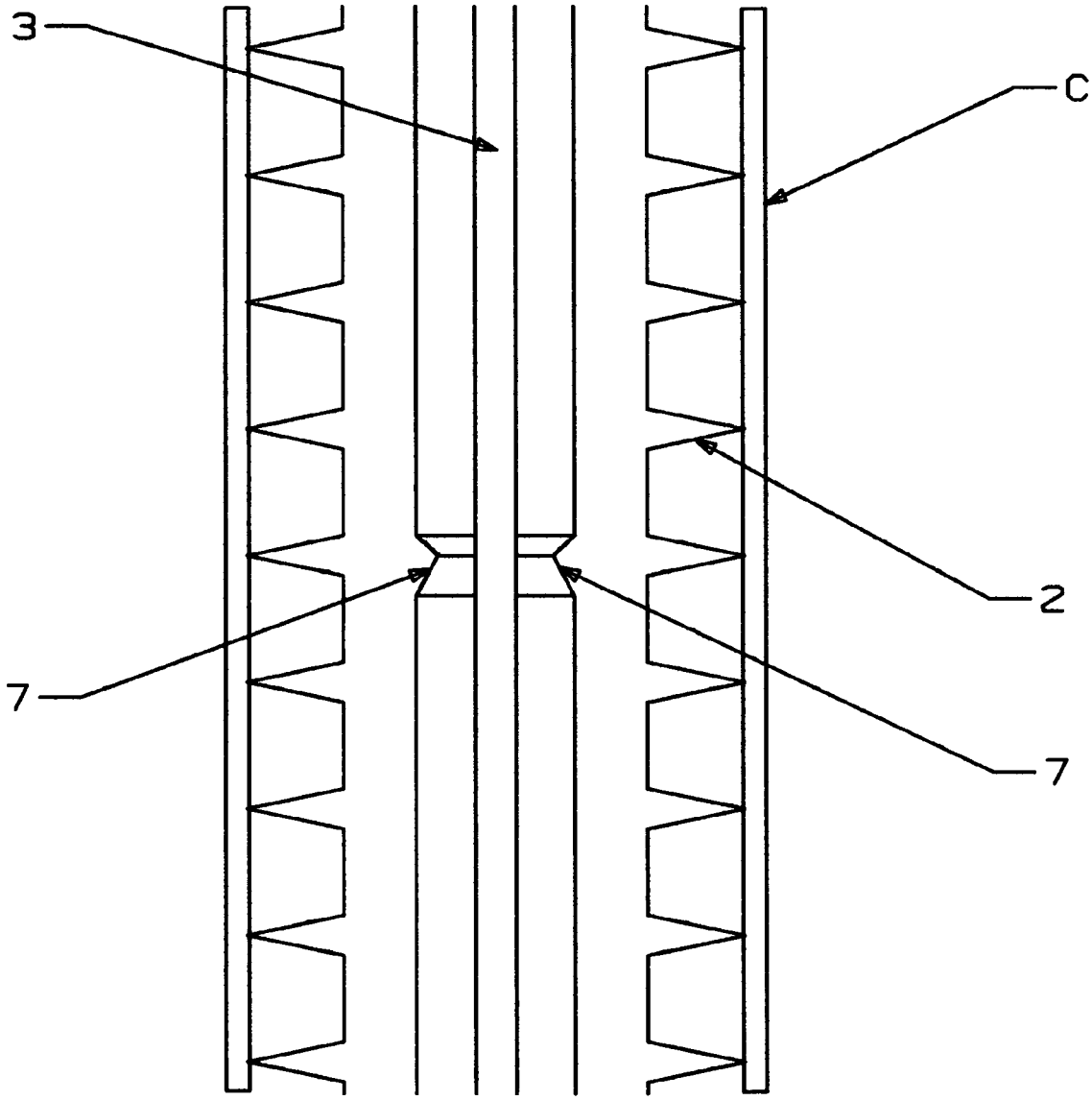
Figure 5:
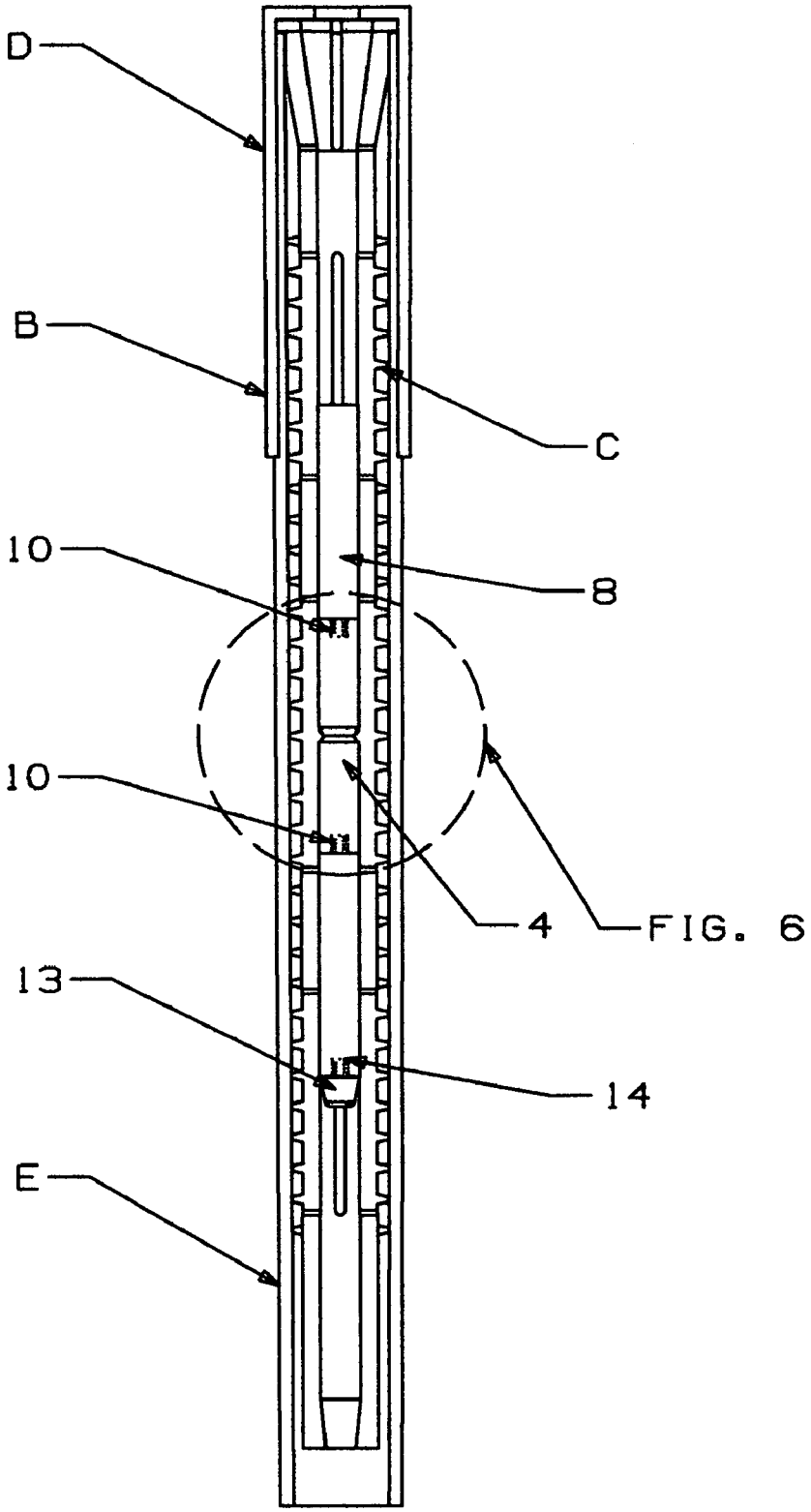
Figure 6:
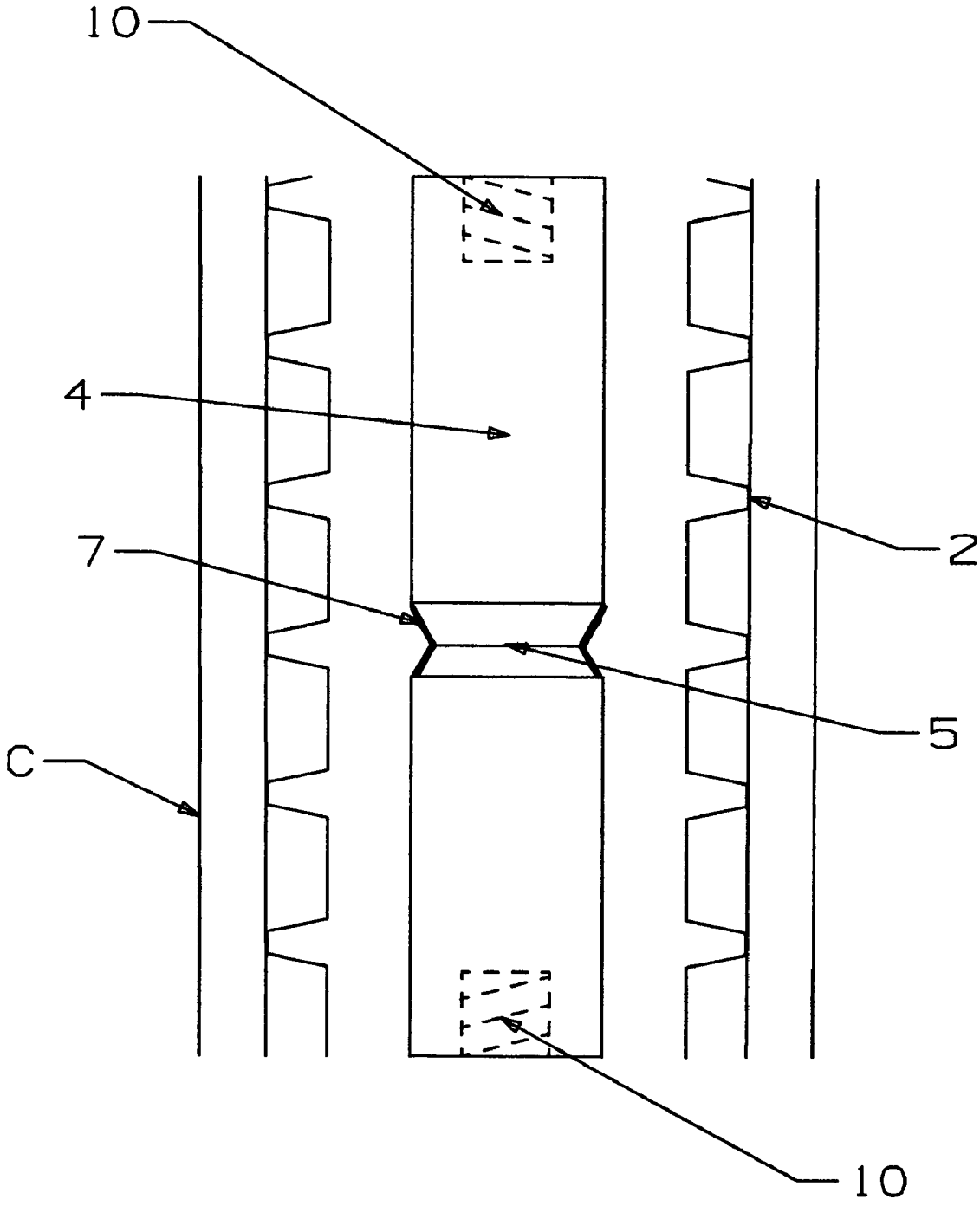
Figure 7:
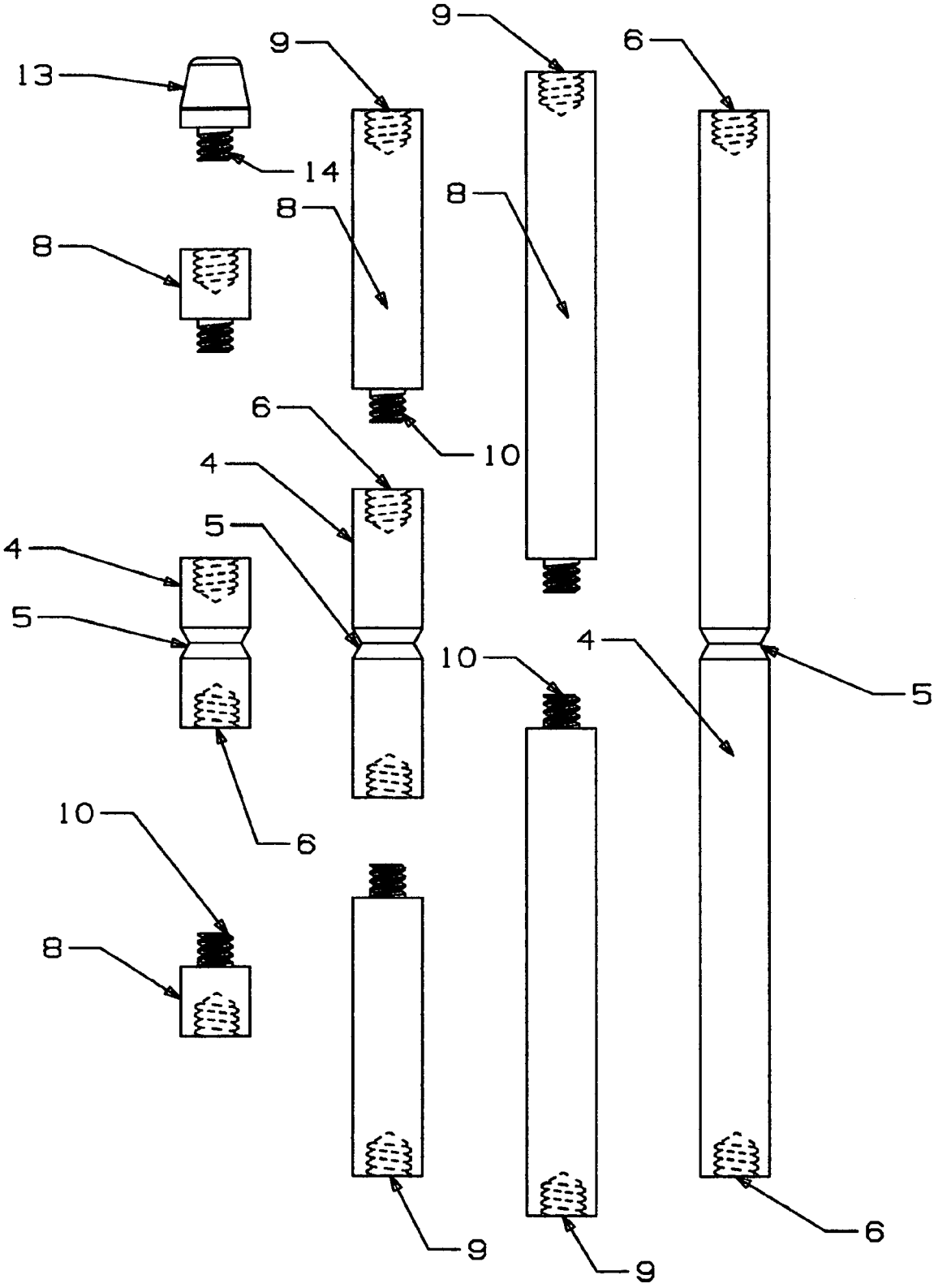
Figure 8:
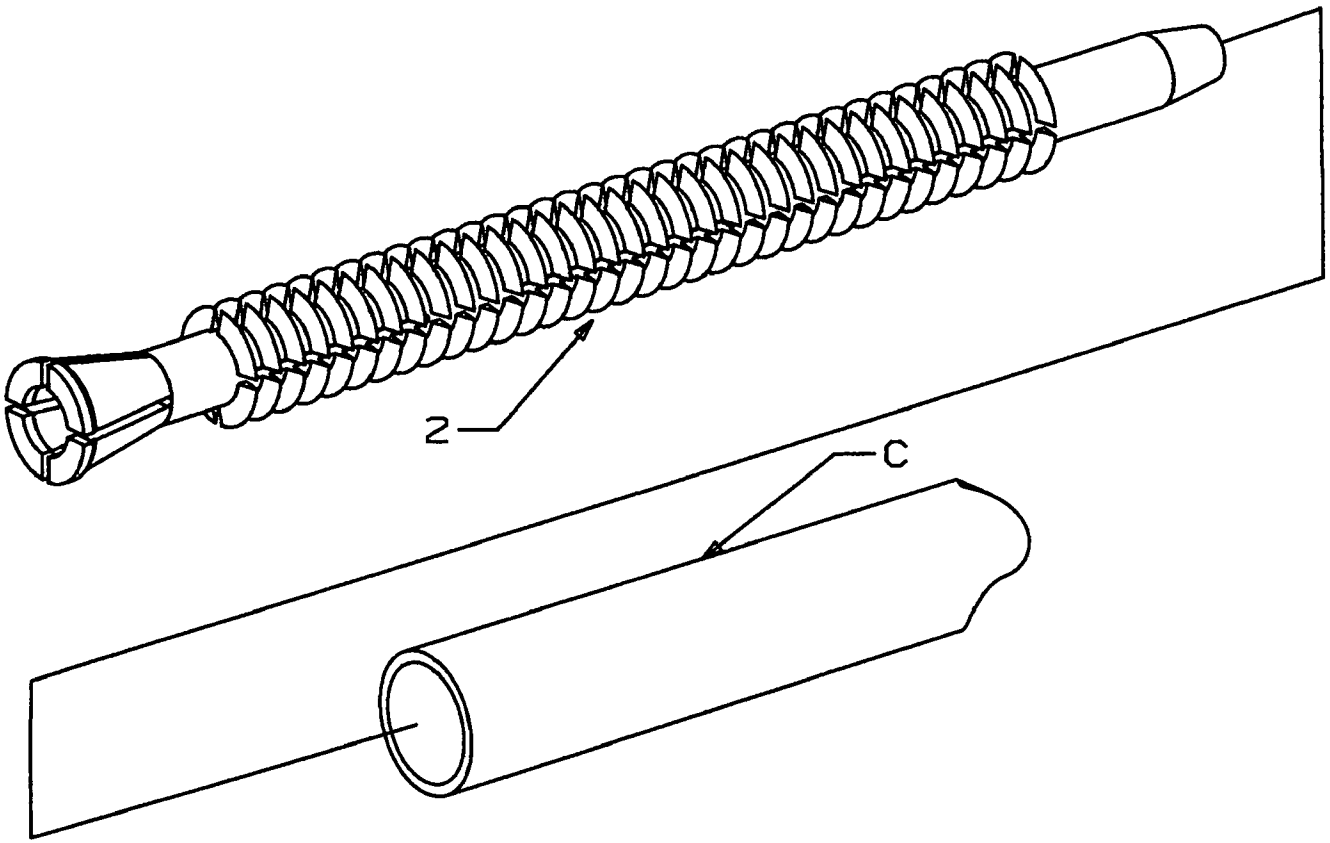
Figure 9:
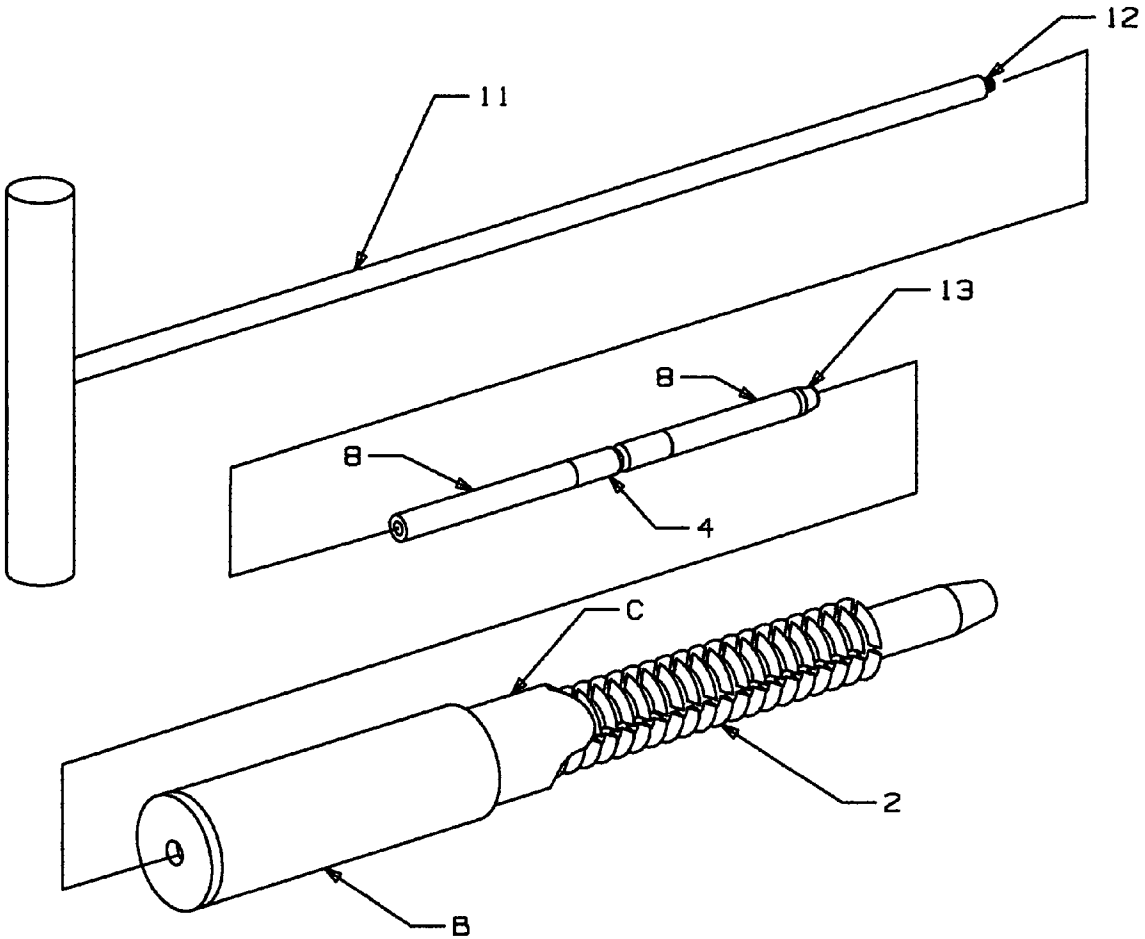

1. FIG. 1 is a depiction of a conventional golf club.
2. FIG. 2 is an isometric view of the housing component of the invention.
3. FIG. 3 is a sagitally cut cross sectional view of the housing component of the invention.
4. FIG. 4 is an isolated view of a portion of what is shown in FIG. 3.
5. FIG. 5 depicts weight units within the lumen of a sagitally cut cross sectional view of the housing component of the invention.
6. FIG. 6 is an isolated view of a portion of what is shown in FIG. 5.
7. FIG. 7 depicts in plan view the weight units of the invention.
8. FIG. 8 depicts in exploded view, the manner of assembly of the housing component of the invention into the upper portion of a golf club shaft.
9. FIG. 9 depicts in exploded view, the assembled modality of the invention.

A DESCRIPTION OF THE PREFERRED EMBODIMENT

The instant invention serves to define a protocol for a centering of weights within an upper portion C of the shaft of a golf club A shown in FIG. 1 as between the points of maximum pressure D and E exerted upon the outer walling of the upper portion C and a golf club grip B therein also shown not only in FIG. 1 but also in FIG. 5 all as a means of enhancing dynamic balance during the course of downswinging by the golfer. Point D is the point of maximum pressure exerted by the upper hand of a golfer upon the upper portion C and grip B and point E is the point of maximum pressure thereupon exerted by the mid-point of the index finger of the golfer's lower hand during at least the downswing portion of the overall swinging of the golf club A. In respect of the same, a pliable housing component 1, with a hollowed out interior region therein and tapered along an upper portion thereof, is inserted into the inner lumen of upper portion C as seen, once again, in both FIGS. 3 and 5. One of a plurality of first weight units 4 shown in FIG. 7 is inserted into the hollowed out interior region of housing component 1 via resort to insertion tool 11 shown in FIG. 9, and, if need be, conjoined prior to such insertion with one of more members of an exemplar pair of a plurality of pairs of second weight units 8 also seen in FIG. 7 such that one of such weight units 4 and perhaps also one or more weight units 8 are positioned within housing component 1; after either weight unit 4 or weight unit 4 conjoined with a weight unit 8 would have perhaps also been initially conjoined with a guide tip unit 13 shown in FIG. 7, so as to ultimately then have all of such inserted weights therein located between the loci of points D and E. The ultimate amount of such weight to be therebetween positioned will vary from golfer to golfer depending upon the inherent natural trueness of the golfer's downswing path into the ball-impact zone near, at and through a stationary golf ball positioned on a tee or on the ground at the lowest point of the golfer's downswing. One purpose of the weights 4 or 4 with 13 or 4 with 8 and 13 so positioned within housing component 1 is to facilitate correction of a golfer's downswing path so as to enable the clubhead of golf club A to; as efficaciously as possible; in light of the golfer's otherwise natural downswing speed and path; squarely meet such a stationary golf ball thereby facilitating more centered post-impact ball flight down a fairway towards a golf green. The other purpose is to facilitate further correction of the golfer's downswing by way of enabling the golfer to then develop an increase in downswing speed to thereby cause the ball post impact to fly further along such a relatively centered path than would be the case with impact following a slower downswing. FIG. 2 serves to depict housing component 1. Flexible, durable ribbing 2 affixed to the external walling of housing component 1 along with a plurality of sets of slits 3 in the walling of housing component 1 permits housing component 1 once flexibly inserted into upper portion C of the shaft of golf club A to be therein flexibly held therein snugly in place. Each set of slits 3 consists ideally of 4 such slits 3 positioned where found about and within the walling of housing component 1, each 90° removed from one another. FIG. 2 moreover serves to illustrate a tapering of the upper portion of housing component 1 with the greatest external diameter of this upper portion being at the very top of housing component 1. This pliable region of greatest external diameter is greater than the greatest inner diameter of upper portion C. This feature provides for stability of positioning of housing component 1 once so inserted into upper portion C, namely serving to militate against any "riding upwardly" of housing component 1 over time with repeated swinging of golf club A by a golfer. The inherent overall pliability of housing component 1 including such pliability as respects this region thereof of greatest external diameter serves along with flexible ribbing 2 and slits 3 to permit snug insertion of the whole of housing component 1 with maximal resultant stability into upper portion C. Once housing component 1 is so inserted and positioned into upper portion C, in the manner illustrated in FIG. 8, then; golf club grip B; previously removed from upper portion C so as to permit such insertion is then replaced onto upper portion C. Weights 4, 4 with 13 or 4 and 8 with 13 are thereafter conjoined and then inserted into the hollowed out interior region of housing component 1 via resort to insertion tool 11 and pushing the same through the hole found in the topside of golf club grip B in the manner illustrated in FIG. 9. Each member 4 of a plurality of first weight units 4 as seen in FIG. 7 is unique as respects mass and length. Each member 4 as seen in FIG. 7, is moreover characterized by the presence of symmetrical concavity 5 at a mid-portion thereof. Moreover, each member 4 has a first weight threaded hole 6 at each end thereof. Symmetrical concavity feature 5 of each member 4 permits each member 4 once inserted into the hollowed out interior portion of housing component 1 in the manner described above to be anchored therein by virtue of the presence of flexible ribbing 7 circularly affixed to and equipping the interior of housing component 1 at near the midpoint of housing component 1. Flexible ribbing 7 is shown puckered into symmetrical concavity 5, for purposes of anchoring a member 4 in place within the hollowed out interior region of housing component 1, in both FIGS. 4 and 6. As will be noted once again with resort to FIG. 7 second weight units 8 are paired within a plurality of pairs. Second weight units 8 like each member 4 of first weight units 4 are removably insertable into the hollowed out interior region of housing component 1 likewise in the manner described above. FIG. 3 depicts the weightless hollowed out interior region of housing components. FIG. 5 depicts the presence of weights therein. Each member of each member pair of the plurality of pairs of second weight units 8 is equivalent in respect of length and mass. Each member pair is however unique in respect of the length and mass of each member 8 thereof as compared to the equivalent lengths and masses of each member of the other member pairs of the plurality of pairs of second weight units 8. It will be further be noted that each member of each pair of second weight units has an on-end threaded hole 9 in one end thereof and on-end external threading 10 affixed at the other end thereof. Optional elongated insertion tool 11 as seen once again in FIG. 9 has a top end gripping handle to facilitate rotation thereof and extraction threading 12 affixed at a bottom end thereof. A weight unit 4 is conjoined with one or more weight members 8 and in turn perhaps also conjoined with a guide tip unit 13 by screwing threading 10 by hand into a hole 6 and guide tip external threading 14 also into a hole 6. Each on-end threaded hole 9 of any member 8 is amenable to receipt of extraction threading 12 as well as the on-end external threading 10 of any member 8. Extraction threading 12 is also amenable to receipt by any first weight threaded hole 6. Moreover, each first weight threaded hole 6 is amenable to receiving on-end external threading 10. Guide tip external threading 14 receivable by any hole 6 or 9 is affixed to the topside of guide tip unit 13 as also seen in FIG. 9. Optional guide tip unit 13 is tapered from top to bottom so as to more readily facilitate insertion of it and other combinations of weights once conjoined together and with it into housing component 1 through the hole in grip B. Removal of a solitary weight unit 4 from within the hollowed out interior region of housing component 1 is accomplished simply by inserting tool 11 through the topside hole in grip B on upper portion C and then screwing it fast via extraction threading 12 into a hole 6, then simply pulling the weight 4 out through the hole in grip B. Similarly, removal of a weight complex consisting of a weight 4 and one or more weights 8 and/or a guide tip unit 13 is accomplished by so inserting tool 11, screwing it fast to a hole 9 via threading 12 and then pulling the complex out through the hole in grip B. Weights 4 and 8 and guide tip 13 as well as external threading 10 and 14 can be made up of a tungsten alloy or a gold alloy or, for that matter, any material; for example metal with a density greater than five grams per centimeter.

The above described features of the invention allow a golfer to either insert one weight unit 4 or one weight 4, first screwed together with one or more weight unit members 8 via resort to insertion tool 11 through the hole in grip B to then be held, as shown above, within previously inserted housing component 1. The variability in the lengths and masses of the various weight units 4 and 8, as well as the relative ease with respect to which any weight unit 4 can be conjoined with one or two weight units 8 in turn conjoinable with other weight units 8 or with guide tip 13 and then inserted into housing component 1 and positioned therein and when desired removed therefrom all as noted above, serve to provide virtually all golfers with the means for easily finding the right total inserted weight for all, each individually so as to provide for maximal dynamic balancing as between the hands of each and indeed all of the irons and woods as would be used by each of them while playing golf.

What is claimed is:

1. A golf club balancing apparatus, comprising:

a. a pliable housing component being tapered along an initial length of an upper portion thereof;

b. flexible ribbing affixed to and equipping a major portion of exterior walling of all of a remaining length of a lower portion of said housing component, with a greatest external diameter of said upper portion of said housing component being greater than a greatest inner diameter of an upper shaft portion of said golf club;

c. a plurality of sets of slits cut into said exterior walling through and into interior walling of said housing component at multiple sites along said length of said upper portion and along said all of said remaining length of said housing component;

d. a plurality of first weight units removably insertable into a hollowed out interior region of said housing component;

e. each one of said plurality of first weight units having a length and mass different from lengths and masses of other ones of said plurality of first weight units;

f. said each one of said plurality of first weight units being featured by symmetrical concavity at a mid-portion of each of said each one of said plurality of first weight units;

g. said each one of said plurality of first weight units having a first weight threaded hole within each end thereof;

h. flexible ribbing circularly affixed to and equipping said interior walling of said housing component at near a midpoint in said housing component for holding one of said each one of said plurality of first weight units at said mid portion thereof;

i. a plurality of pairs of second weight units removably insertable into said hollowed out interior region of said housing component;

j. each member of each member pair of said plurality of pairs of second weight units having equivalent length and mass;

k. said each member pair of said plurality of pairs of second weight units being different than any other such said each member pair within said plurality of pairs of second weight units in respect of length and mass;

l. each member of said each member pair of said plurality of pairs of second weight units having an on-end threaded hole in one end thereof and on-end external threading affixed at an other end thereof;

m. an elongated insertion tool with a gripping handle at an upper end thereof and extraction threading affixed at a bottom end thereof;

n. each said on-end threaded hole being amenable to receipt of said extraction threading as well as said on-end external threading;

o. said on-end external threading being also amenable to receipt by each of said first weight threaded holes, and;

p. each said first weight threaded hole being also amenable to receiving said extraction threading.

2. The golf club balancing apparatus of claim 1, whereby, said each one of said plurality of first weight units and each said each member pair of said plurality of pairs of second weight units and said external threading affixed to said each member of said said each member pair are made of a tungsten alloy material.

3. The golf club balancing apparatus of claim 1, whereby, said each one of said plurality of first weight units and each said each member pair of said plurality of pairs of second weight units and said external threading affixed to said each member of said each member pair are made of a gold alloy material.

4. The golf club balancing apparatus of claim 1, whereby, said each one of said plurality of first weight units and each said each member pair of said plurality of pairs of second weight units and said external threading affixed to said each member of said said each member pair are made of a material with density greater than five grams per centimeter.

5. A golf club balancing apparatus, comprising:

a. a pliable housing component being tapered along an initial length of an upper portion thereof;

b. flexible ribbing affixed to and equipping a major portion of exterior walling of all of a remaining length of a lower portion of said housing component, with a greatest external diameter of said upper portion of said housing component being greater than a greatest inner diameter of an upper shaft portion of said golf club;

c. a plurality of sets of slits cut into said exterior walling through and into interior walling of said housing component at multiple sites along said length of said upper portion and along said all of said remaining length of said housing component;

d. a plurality of first weight units removably insertable into a hollowed out interior region of said housing component;

e. each one of said plurality of first weight units having a length and mass different from lengths and masses of other ones of said plurality of first weight units;

f. said each one of said plurality of first weight units being featured by symmetrical concavity at a mid-portion of each of said each one of said plurality of first weight units;

g. said each one of said plurality of first weight units having a first weight threaded hole within each end thereof;

h. flexible ribbing circularly affixed to and equipping said interior walling of said housing component at near a midpoint in said housing component for holding one of said each one of said plurality of first weight units at said mid portion thereof;

i. a plurality of pairs of second weight units removably insertable into said hollowed out interior region of said housing component;

j. each member of each member pair of said plurality of pairs of second weight units having equivalent length and mass;

k. said each member pair of said plurality of pairs of second weight units being different than any other such said each member pair within said plurality of pairs of second weight units in respect of length and mass;

l. each member of said each member pair of said plurality of pairs of second weight units having an on-end threaded hole at one end thereof and on end external threading affixed at an other end thereof;

m. an elongated insertion tool with a gripping handle at an upper end thereof and extraction threading affixed at a bottom end thereof;

n. each said on-end threaded hole being amenable to receipt of said extraction threading as well as said on-end external threading;

o. said on-end external threading being also amenable to receipt by each of said first weight threaded holes;

p. each said first weight threaded hole being also amenable to receiving said extraction threading;

q. a tapered guide tip unit with length and mass and with guide tip external threading affixed to a topside thereof, and;

r. said guide tip external threading being receivable by each said first weight threaded hole as well as each said on-end threaded hole.

6. The golf club balancing apparatus of claim 5, whereby, said each one of said plurality of first weight units and each said each member pair of said plurality of pairs of second weight units and said external threading affixed to said each member of said said each member pair and said guide tip and said guide tip external threading are made of a tungsten alloy material.

7. The golf club balancing apparatus of claim 5, whereby, said each one of said plurality of first weight units and each said each member pair of said plurality of pairs of second weight units and said external threading affixed to said each members of said each members of said each member pair and said guide tip and said guide tip external threading are made of a gold alloy material.

8. The golf club balancing apparatus of claim 5, whereby, said each one of said plurality of first weight units and each said each member pair of said plurality of pairs of second weight units and said external threading affixed to said each member of said said each member pair and said guide tip and said guide tip external threading are made of a material with density greater than five grams per centimeter.

* * * * *